US005836901A

United States Patent [19]

Shenkal et al.

[11] Patent Number: 5,836,901

[45] Date of Patent: Nov. 17, 1998

[54] HAND HELD MASSAGING DEVICE HAVING CONTACT ELEMENTS WITH FINGER HOLD CAVITIES

[75] Inventors: Yuval Shenkal, San Diego, Calif.; Myra S. Per-Lee, 16136 Avenida Venusto, #2, San Diego, Calif. 92128

[73] Assignee: Myra S. Per-Lee, San Diego, Calif.

[21] Appl. No.: 790,924

[22] Filed: Jan. 29, 1997

[51] Int. Cl.[6] ..... A61H 7/00

[52] U.S. Cl. ..... 601/135; 601/134; 601/137; 601/136

[58] Field of Search ..... 601/134, 135, 601/136, 137, 133; D24/211; 482/47

[56] References Cited

U.S. PATENT DOCUMENTS

| | | | |
|---|---|---|---|
| D. 280,664 | 9/1985 | Ishida | D24/36 |
| D. 328,328 | 7/1992 | Juarez | D24/211 |
| D. 346,449 | 4/1994 | Cheng | D24/211 |
| D. 372,313 | 7/1996 | McMillan et al. | D24/211 |
| 915,251 | 3/1909 | Vanderslice . | |
| 1,554,510 | 9/1925 | Kirby | 601/137 |
| 1,885,572 | 11/1932 | Wood | 601/137 |
| 1,913,462 | 6/1933 | Timar | 601/137 |
| 2,547,243 | 4/1951 | Amer | 128/67 |
| 2,806,470 | 9/1957 | Ferrier | 128/60 |
| 2,836,175 | 5/1958 | Nakayama | 128/60 |
| 3,545,434 | 12/1970 | Woodruff | 128/62 |
| 4,308,860 | 1/1982 | Sanders et al. | 601/137 |
| 5,195,510 | 3/1993 | Svacina | 128/61 |
| 5,382,222 | 1/1995 | Yih-Jong | 601/137 |

FOREIGN PATENT DOCUMENTS

| | | | |
|---|---|---|---|
| 18840 | of 1912 | United Kingdom | 601/135 |
| 404853 | 1/1934 | United Kingdom | 601/137 |
| 2019220 | 10/1979 | United Kingdom | 601/137 |

*Primary Examiner*—Richard J. Apley
*Assistant Examiner*—Benjamin Koo
*Attorney, Agent, or Firm*—Flanagan & Flanagan; John K. Flanagan; John R. Flanagan

[57] ABSTRACT

A hand held massaging device includes a support body and a plurality of contact elements extending from the support body. The support body has a top facing the palm of a hand of a user, a bottom facing away from the palm of the hand of the user, a plurality of peripheral sides surrounding the top and the bottom of the support body, and a plurality of corners defined at adjacent ends of the peripheral sides. The plurality of contact elements are attached to the respective corners of the support body and extend downwardly from the bottom of the support body at the plurality of corners thereof. The plurality of contact elements define a plurality of cavities closed at bottom ends and having openings at the top ends of the contact elements adjacent to the top of the support body for receiving some of the fingers and thumb of the hand of the user therein for directing the plurality of contact elements over the surface of a body during a massage.

20 Claims, 1 Drawing Sheet

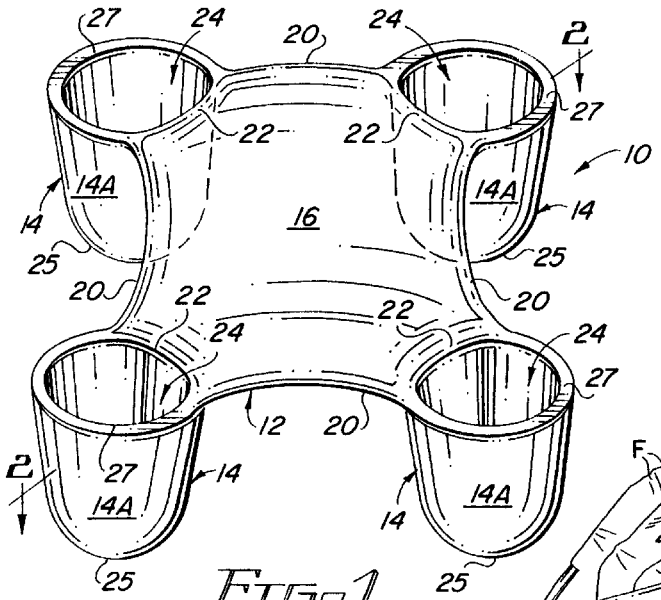
FIG. 1
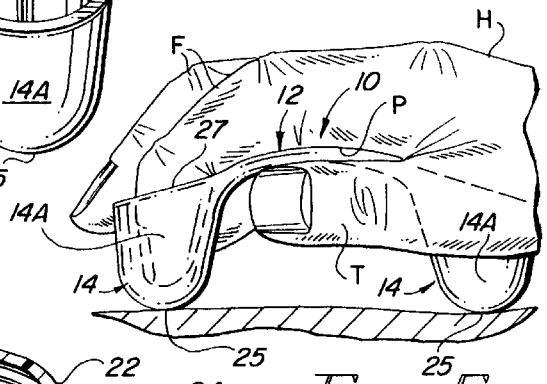
FIG. 5
FIG. 2
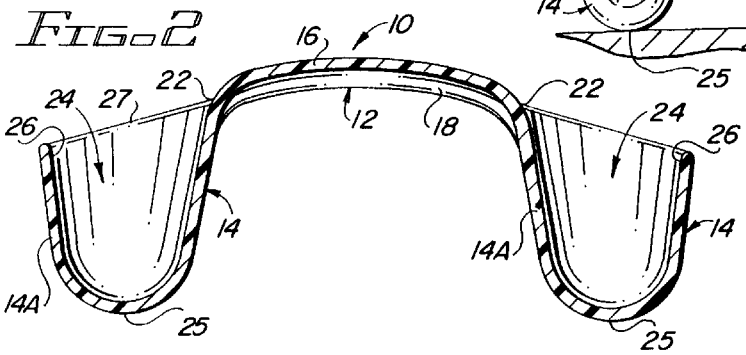
FIG. 3
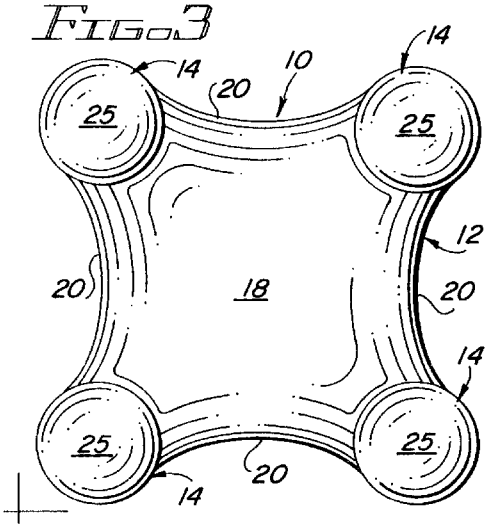
FIG. 4
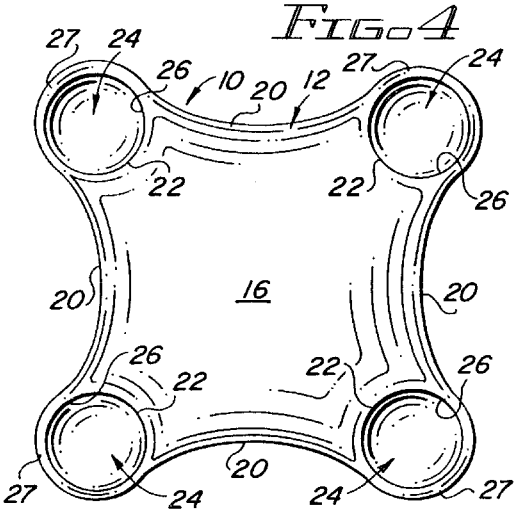

HAND HELD MASSAGING DEVICE HAVING CONTACT ELEMENTS WITH FINGER HOLD CAVITIES

BACKGROUND OF THE INVENTION

1. Field of the Invention

The present invention generally relates to devices for massaging the human body and, more particularly, is concerned with a hand held massaging device having contact elements with finger hold cavities.

2. Description of the Prior Art

The practice of massage can be useful for any of a variety of reasons, including therapy and pleasure. It is sometimes the case, however, that direct use of the fingers and thumb of the hand is not the most effective means for achieving a desired outcome. The hand alone may not provide the optimum symmetry and consistency of contact necessary for a beneficial massage. Assistance can be provided in any number of ways. Various devices have been devised over the years to aid the hand in the act of massage.

Representative examples of these prior art devices are disclosed in Des. U.S. Pat. No. 328,328 to Juarez, U.S. Pat. No. 915,251 to Vanderslice, U.S. Pat. No. 1,913,462 to Timar, U.S. Pat. No. 2,547,243 to Amer, U.S. Pat. No. 2,806,470 to Ferrier, U.S. Pat. No. 2,836,175 to Nakayama, U.S. Pat. No. 3,545,434 to Woodruff, U.S. Pat. No. 5,195,510 to Svacina, U.S. Pat. No. 5,382,222 to Yih-Jong and British Pat. Nos. 18,840, 404,853 and 2,019,220. Common features in these prior art devices include a body and massage projections. None of these devices, however, appears to provide direct control of the projections by the fingers and thumb of the hand of a user.

Consequently, a need still exists for a device which provides a solution to the aforementioned problem in the prior art without introducing any new problems in place thereof.

SUMMARY OF THE INVENTION

The present invention provides a hand held massaging device designed to satisfy the aforementioned need. The hand held massaging device of the present invention has finger hold cavities within cup-shaped elements which contact the body during a massage. These finger hold cavities enable insertion of the end portions of some of the fingers and thumb of the user into the contact elements to directly control the contact elements. Furthermore, the contact elements are disposed on a support body in a way which provides for optimum symmetry and consistency in bodily contact to enable the user to give an effective massage.

Accordingly, the present invention is directed to a hand held massaging device which comprises: (a) a support body; and (b) a plurality of contact elements attached to and extending in the same direction away from the support body. The support body has a top for facing the palm of a hand of a user, a bottom for facing away from the palm of the hand of the user, a plurality of peripheral sides surrounding the top and the bottom, and a plurality of corners defined at adjacent ends of the plurality of peripheral sides of the support body and forming intersections thereof. The plurality of contact elements extend downwardly from the bottom at the plurality of corners of the support body. The plurality of contact elements define a plurality of cavities closed at bottom ends and having openings at top ends of the contact elements adjacent to the top of the support body for receiving the end portions of some of the fingers and thumb of the hand of the user therein for directing the plurality of contact elements over the surface of a body during a massage.

More particularly, the top of the support body has a substantially convex configuration which conforms to the shape of the palm of the hand of the user. Each of the plurality of contact elements is formed by a cup-shaped wall having a substantially elliptical configuration. The support body and the plurality of contact elements are preferably molded from a suitable plastic material. The support body and the plurality of contact elements, though substantially rigid, are preferably slightly pliable such that the fingers and the thumb of the hand of the user can flex the support body and the plurality of contact elements in the process of massaging a body.

Pliability enables the device to resemble the hand and to be more conforming to body contours. The plurality of contact elements preferably are arranged symmetrical in relation to the center of the support body so as to have optimum symmetry and consistency in bodily contact which a hand alone cannot provide. However, other arrangements of the contact elements are acceptable.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a top perspective view of a hand held massaging device of the present invention.

FIG. 2 is a cross-sectional view of the hand held massaging device taken along line 2—2 of FIG. 1.

FIG. 3 is a bottom plan view of the device on a reduced scale as compared to FIG. 1.

FIG. 4 is a top plan view of the device on a reduced scale as compared to FIG. 1.

FIG. 5 is a side elevational view of the device on a reduced scale as compared to FIG. 1 and showing the hand of a user.

DETAILED DESCRIPTION OF THE INVENTION

Referring to the drawings and particularly to FIGS. 1 and 5, there is illustrated a hand held massaging device, generally designated 10, of the present invention. The hand held massaging device 10 basically includes a support body 12 and a plurality of hollow contact elements 14. The support body 12 has a top 16 for facing the palm P of a hand H of a user, a bottom 18 for facing away from the palm P of the hand H of the user, a plurality of peripheral sides 20 surrounding the top 16 and the bottom 18, and a plurality of corners 22 at adjacent ends of the plurality of peripheral sides 10 and defining intersections of the sides 20. The plurality of contact elements 14 are formed by generally cup-shaped walls 14A attached to the corners 22 of the support body 12. The cup-shaped walls 14A are spaced apart from one another about the peripheral sides 20 of the support body 12 and are disposed outwardly from the top 16 and bottom 18 of the support body 12 and extend in the same direction downwardly away from the bottom from the bottom 18 of the support body 12 at the plurality of corners 22 thereof. The cup-shaped walls 14A of the plurality of contact elements 14 define a plurality of hollow cavities 24 having rounded closed bottom ends 25 and openings 26 at top ends 27 adjacent to the top 16 of the support body 12 for receiving end portions of some of the fingers F and thumb T of the hand H of the user therein for directing the plurality of contact elements 14 over the surface of a body during a massage.

Referring now to FIGS. 1 to 5, the respective above-mentioned portions of the support body 12 have a variety of preferred shapes although they can have other shapes as well. The top 16 of the support body 12 has a substantially convex configuration which conforms to the shape of the palm P of the hand H of the user but can have any other suitable configuration as well. The bottom 18 of the support body 12 has a substantially concave configuration but can have any other suitable configuration as well. Each of the plurality of peripheral sides 20 of the support body 12 has a substantially concave configuration but can have any other suitable configuration. Each of the plurality of corners 22 of the support body 12 has a substantially round configuration but can have any other suitable configuration. The cup-shaped wall 14A of each of the contact elements 14 preferably has a substantially elliptical shape but other shapes are possible.

The support body 12 and the plurality of contact elements 14 are preferably molded from a plastic material but can be made from any suitable material. The plurality of contact elements 14 also preferably are symmetrical in relation to the center of the support body 12 but are not so limited. The support body 12 and the plurality of contact elements 14 preferably have a thickness substantially similar to one another but this need not be so. The plurality of contact elements 14 preferably are rigidly attached to the support body at the plurality of corners 22 thereof. Furthermore, the support body 12 and the plurality of contact elements 14, though substantially rigid, are preferably slightly pliable such that the fingers F and the thumb T of the hand H of the user can flex the support body 12 and the plurality of contact elements 14 in the process of massaging a body. This pliability enables the device 10 to resemble the hand H, to be more conforming to body contours and, by also being symmetrical in relation to the center of the support body 12, to thus have optimum symmetry and consistency in bodily contact which a hand H alone cannot provide. The smooth surface of top 16 allows for placement of indicia, such as advertising information, thereon. The material of the device 10 can be opaque or transparent. Also, the shape and arrangement of the contact elements 14 allows nesting and stacking of the devices 10 on one another for retail handling and display purposes and for retention of user information and instruction cards.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hand held massaging device, comprising:

(a) a support body having a top for facing the palm of a hand of a user, a bottom for facing away from the palm of the hand of the user, a plurality of peripheral sides surrounding said top and said bottom, and a plurality of corners defined at adjacent ends of said peripheral sides; and (b) a plurality of hollow contact elements attached to said respective corners of said support body, each of said contact elements being a cup-shaped wall spaced apart from one another about said peripheral sides of said support body and disposed outwardly from said top and bottom of said support body and extending downwardly away from said bottom of said support body at one of said respective corners of said support body, each of said cup-shaped walls forming a hollow cavity having an opening at a top end of said cup-shaped wall disposed outwardly from and adjacent to said respective corner and said top of said support body for receiving at least one of the fingers and thumb of the hand of the user therein for directing said plurality of contact elements over the surface of a body during a massage.

2. The device of claim 1 wherein said top of said support body has a substantially convex configuration.

3. The device of claim 1 wherein said bottom of said support body has a substantially concave configuration.

4. The device of claim 1 wherein each of said plurality of peripheral sides of said support body has a substantially concave configuration.

5. The device of claim 1 wherein each of said plurality of corners of said support body has a substantially round configuration.

6. The device of claim 1 wherein said cavities of said plurality of contact elements have closed bottom ends opposite from said open top ends.

7. The device of claim 1 wherein said support body and said plurality of contact elements have a thickness substantially similar to one another.

8. The device of claim 1 wherein said support body and said plurality of contact elements are substantially transparent.

9. The device of claim 1 wherein said support body and said plurality of contact elements are slightly pliable.

10. The device of claim 1 wherein said plurality of contact elements are substantially symmetrical in relation to the center of said support body.

11. The device of claim 1 wherein each of said cup-shaped walls has a substantially elliptical configuration.

12. A hand held messaging device, comprising:

(a) a support body having a convex top for facing the palm of a hand of a user, a concave bottom for facing away from the palm of the hand of the user, a plurality of concave peripheral sides surrounding said top and said bottom, and a plurality of corners defined at adjacent ends of said concave peripheral sides; and (b) a plurality of hollow contact elements attached to said respective corners of said support body, each of said contact elements being a cup-shaped wall spaced apart from one another about said peripheral sides of said support body and disposed outwardly from said top and bottom of said support body and extending downwardly in the same direction away from said bottom at one of said respective corners of said support body, each of said cup-shaped walls defining a hollow cavity having an opening at a top of said cup-shaped wall disposed outwardly from and adjacent to said respective corner and said top of said support body for receiving at least one of the fingers and thumb of the hand of the user therein for directing said plurality of contact elements over the surface of a body during a massage, said support body and contact elements being substantially rigid although slightly pliable such that said support body and contact elements can flex relative to each other in the process of massaging the body.

13. The device of claim 12 wherein said support body and said plurality of contact elements have a thickness substantially similar to one another.

14. The device of claim 12 wherein said support body and said plurality of contact elements are slightly pliable.

15. The device of claim 12 wherein said plurality of contact elements are substantially symmetrical in relation to the center of said support body.

16. The device of claim 12 wherein each of said cup-shaped walls has a substantially elliptical configuration.

17. A hand held massaging device, comprising:

(a) a support body having a convex top for facing the palm of a hand of a user, a concave bottom for facing away from the palm of the hand of the user, a plurality of concave peripheral sides surrounding said top and said bottom, and a plurality of corners defined at adjacent ends of said peripheral sides and forming intersections thereof; and (b) a plurality of hollow contact elements each formed by a cup-shaped wall of elliptical configuration attached to one of said respective corners of said support body and spaced apart from one another about said peripheral sides of said support body, each of said cup-shaped walls disposed outwardly from said top and bottom of said support body and extending downwardly away from said bottom of said support body at one of said respective corners of said support body said cup-shaped walls being disposed symmetrically with respective to one another in relation to a center of said support body, each of said cup-shaped walls defining a hollow cavity having a closed bottom end and an opening at a top end of said cup-shaped wall disposed outwardly from and adjacent to said respective corner and said top of said support body for receiving end portions of at least one of the fingers and thumb of the hand of the user therein for directing said plurality of elliptical contact elements over the surface of a body during a massage;

(c) said support body and said plurality of elliptical contact elements being molded from a plastic material and being substantially rigid although slightly pliable such that said support body and contact elements can flex relative to each other in the process of massaging the body.

18. The device of claim 17 wherein said support body and said plurality of elliptical contact elements are substantially transparent.

19. The device of claim 17 wherein said support body and said plurality of elliptical contact elements have a thickness substantially similar to one another.

20. The device of claim 17 wherein said support body and said plurality of elliptical contact elements are slightly pliable.

* * * * *